US005198409A

United States Patent [19]

Rowan et al.

[11] Patent Number: 5,198,409

[45] Date of Patent: Mar. 30, 1993

[54] THERMAL DYE TRANSFER IMAGED FOCUSSING TOOL

[75] Inventors: Stephen J. Rowan, Spencerport; Charles D. DeBoer, Rochester, both of N.Y.

[73] Assignee: Eastman Kodak Company, Rochester, N.Y.

[21] Appl. No.: 837,469

[22] Filed: Feb. 14, 1992

[51] Int. Cl.[5] ..... B41M 5/035; B41M 5/38

[52] U.S. Cl. ..... 503/227; 40/159.2; 250/491.1; 428/13; 428/14; 428/195; 428/913; 428/914; 428/192; 430/322; 430/331; 430/945

[58] Field of Search ..... 8/471; 40/491.1; 428/13, 14, 192, 195, 913, 914; 430/322, 331, 945; 503/227

[56] References Cited

U.S. PATENT DOCUMENTS 4,873,135 10/1989 Wittnebel et al. ..... 428/192

OTHER PUBLICATIONS

U.S. Ser. No. 07/722,810 of Sarraf et al., filed Jun. 28, 1991.

*Primary Examiner*—B. Hamilton Hess

*Attorney, Agent, or Firm*—Andrew J. Anderson

[57] ABSTRACT

A dye-receiving element for thermal dye transfer suitable for forming a focussing tool comprising a polymeric central dye image-receiving section having a substantially planar image receiving surface and a relatively thicker integral polymeric frame section extending around the periphery of said central section, said image receiving surface being formed at an inclined angle relative to the frame section. The invention further includes a process of forming an imaged focussing tool by the steps of a) imagewise-heating a dye-donor element comprising a support having thereon a dye layer, and b) transferring portions of the dye layer in a pattern corresponding to a desired focussing image to a dye-receiving element as described above, and imaged focussing tools obtained by such a process.

20 Claims, 1 Drawing Sheet

THERMAL DYE TRANSFER IMAGED FOCUSSING TOOL

This invention relates to thermal dye transfer receiving elements, and more particularly to receiving elements which are suitable for forming a focussing tool.

Focussing tools generally contain a reflection or transmission reticule image. In use, such images are magnified through a microscope viewer or by projection onto a screen. For the purpose of focussing a photographic printer, a reticule image approximately 20×29 mm in size may customarily be enlarged to 3.5×5 inches in size by projection onto a screen or printable material such as photographic paper, an enlargement factor of approximately 4.5. Such magnifications require very high resolution images with sharp edges if accurate focussing is to be accomplished. In addition, a reticule image should be uniformly planar across the image surface, so that the focal plane of the image does not change from the center to the edges of the image.

One particular type of focussing tool is exemplified by the KODAK ® Printer Focus Scale Negatives (Catalogue Numbers 105 9195, 105 9211, and 131 2636). In use, these focussing tools are held in a photographic printer with the center point of the focal plane of a reticule image positioned at the normal printing plane for photographic negatives, the image plane positioned at a 5° angle relative to the surface of a photographic paper to be printed. With the center of the inclined image at the correct point, one end of the image is too close to the lens of the printer, and the other end is too far away from the lens. A photographic print made of the inclined reticule image with a correctly focussed printer lens thus shows a blurry image at both ends of the print with a correctly focussed image in the center of the print. If the portion of the print which is in-focus is off-center, the operator of the photographic printer knows the lens is not adjusted properly, and can make any needed corrections. In order to assure that the center point of the inclined image is positioned at the normal focal plane of the printer, the focus tool is provided with mechanical stops, or edges, to hold the tool at the correct position and angle. The inclined portion of the focussing tool consists of a sheet of glass coated with a photographic emulsion which has been exposed and developed to form an appropriate reticule image. The whole assembly of emulsion coated glass with the precision holder is relatively complex, expensive and fragile. It would be desirable to provide a focussing tool which was simple to make, economical, and robust.

These and other objects are achieved in accordance with this invention which comprises a dye-receiving element for thermal dye transfer suitable for forming a focussing tool comprising a polymeric central dye image-receiving section having a substantially planar image receiving surface and a relatively thicker integral polymeric frame section extending around the periphery of said central section, said image receiving surface being formed at an inclined angle relative to the frame section.

The invention also comprises a process of forming an imaged focussing tool comprising the steps of (a) image-wise-heating a dye-donor element comprising a support having thereon a dye layer, and b) transferring portions of the dye layer in a pattern corresponding to a desired focussing image to a dye-receiving element suitable for forming a focussing tool as described above.

The invention further comprises an imaged focussing tool obtained from the process of the invention.

A detailed description of the invention is given below with reference to the drawings, wherein.

In recent years, thermal transfer systems have been developed to obtain printed images. According to one way of obtaining such prints, a line-type thermal printing head may be used to apply heat from the back of a dye-donor sheet aligned with a dye receiver. The thermal printing head has many heating elements which are heated selectively in response to electronic signals corresponding to a desired image to be printed, thereby transferring dye from the donor to the receiver in an image-wise manner. Further details of this process and an apparatus for carrying it out are contained in U.S. Pat. No. 4,621,271 by Brownstein entitled "Apparatus and Method For Controlling A Thermal Printer Apparatus, issued Nov. 4, 1986, the disclosure of which is hereby incorporated by reference.

Another way to thermally obtain an image using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the desired image, so that each dye is heated to cause volatilization only in those areas in which its presence is required on the receiver to construct the color of the desired image. Further details of this process are found in GB 2,083,726A, the disclosure of which is hereby incorporated by reference. Additional sources of energy that may be used to thermally transfer dye from a donor to a receiver include light flash and ultrasound.

Figure 1:
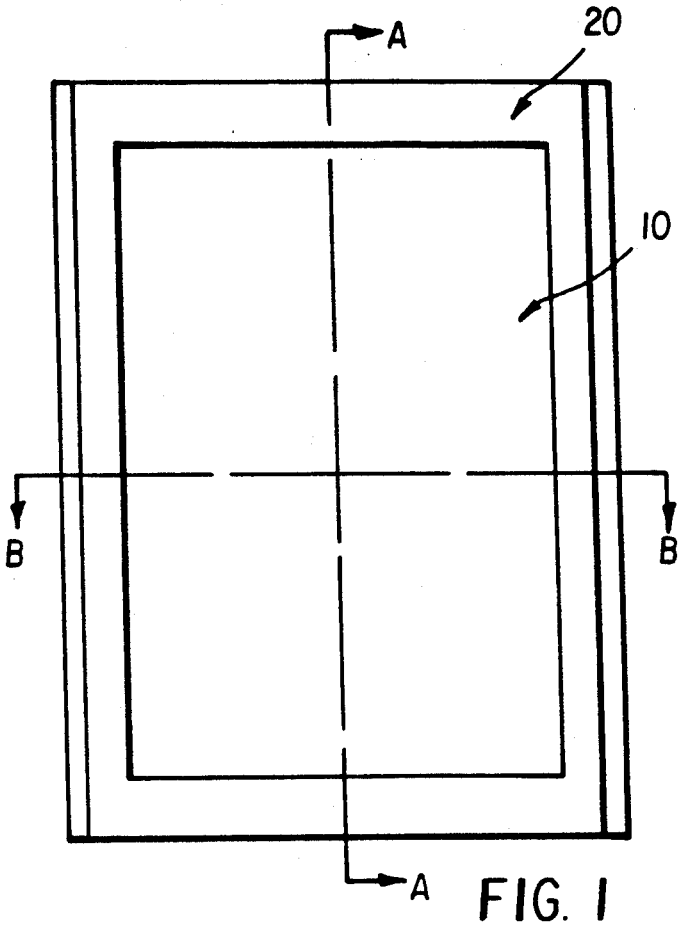
FIG. 1 is a plan view of one side of an integral thermal dye transfer receiver-frame suitable for forming a focussing tool according to the present invention.
Figure 2:
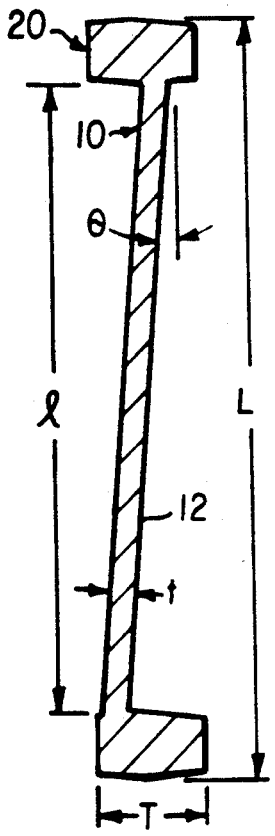
FIG. 2 is a cross-sectional view, taken along line "A—A" of FIG. 1, of the integral receiver-frame illustrated in FIG. 1.
Figure 3:
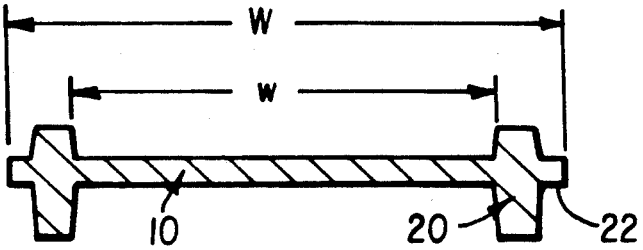
FIG. 3 is a cross-sectional view, taken along line "B—B" of FIG. 1, of the integral receiver-frame illustrated in FIG. 1.

An integral receiver-frame format comprising dye-image receiving section 10 and frame section 20 as shown in FIGS. 1-3 has been devised that permits a reticule image to be formed by thermal dye-transfer directly on an integral unit to form a focussing tool. No separate step of mounting or assembling of emulsion coated reticule image planes and precision holders is required.

The frame length L and width W dimensions (FIGS. 2 and 3) may be chosen so that the receiver-frame is of a size suitable for use in a photographic printer. Most commercial photographic printers are designed to accommodate conventional photographic negatives. Most conventional photographic negatives are approximately 24 mm by 35 mm.

The central dye image-receiving section length l and width w dimensions (FIGS. 2 and 3) are selected to provide sufficient area for forming a desired reticule image, while still maintaining a sufficient peripheral frame width such that the integral receiver-frame exhibits adequate dimensional stability and sufficient frame area so that the receiver-frame may be accurately positioned in the focal plane of the printer aperture. Central area widths w of about 20 mm and lengths l of from about 29 mm are preferred for focussing tools with overall lengths L of about 35 mm and widths W of about 24 mm.

The central dye image-receiving surface 12 (FIG. 2) of central section 10 is formed at an inclined angle $\theta$ relative to frame section 20. As long as it is greater than zero, the angle degree is not critical, but is preferably from about 1 to about 15 degrees, more preferably from 2 to 10 degrees, about 5 degrees being most preferred.

The integral receiver-frames for the focussing tools of the invention may be produced by any technique known in the "plastics art", such as injection molding, vacuum forming, or the like. The integral receiver-frame is conveniently produced from thermoplastic polymers, copolymers or mixtures of polymers that are moldable or extrudable and have the capability of accepting a thermally transferable dye.

The dye image-receiving section may be tinted to provide a uniform colored background for printed images, or the dye image-receiving section may be substantially transparent (e.g. having an optical transmission of 85% or greater) in order to maximize design flexibility for transferred reticule images. Logos or identification marks (not illustrated) may also be included in the border or central image area. Further conventional focussing tool features may also be incorporated into the integral receiver-frames of the invention. Indentations, e.g., may be molded in the edge of the border to be used as reference markers for positioning of the focussing tool in a photographic printer. Mechanical stops or edges 22 (FIG. 3) may be molded which are designed to hold the tool at the correct position and angle in order to assure that the center point of the inclined image is positioned at the normal focal plane of the printer.

The polymeric material used for the outer frame and center image area may be the same, or other components may be selectively added to one part or the other. Two different polymers may be used for each of the frame or receiver providing they are compatible for molding. These concepts are well known in the art as described in the book "Injection Molding of Plastics" by Islyn Thomas, Reinhold Publishing Company, N. Y., 1947, which is incorporated by reference.

A variety of polymers are known to be suitable as receiving layers for thermal dye transfer using such techniques as laser, thermal head, or flash lamp. Within this broad class of polymers, those that are preferred for production of an integral receiver-frame, however, are more selective. Polymers applicable for use in the present invention include those disclosed in copending, commonly assigned U.S. Ser. No. 07/722,810 of Sarraf et. al., the disclosure of which is incorporated by reference. This copending application describes integral thermal dye transfer receiving elements, similar to the present invention, suitable for forming framed slides for projection viewing.

Preferred polymers for production of an integral receiver-frame are thermoplastic and meltable for casting or extrusion at a temperature between about 100° to 350° C. Among various polymers, polycarbonates alone or in mixture with other polyesters and copolymers of polycarbonates and other polyesters are considered preferred. The term "polycarbonate" as used herein means a polyester of carbonic acid and a glycol and/or a dihydric phenol. Examples of such glycols or dihydric phenols are p-xylylene glycol, 2,2-bis(4-oxyphenyl) propane, bis(4-oxyphenyl)methane, 1,1-bis(4-oxyphenyl) ethane, 1,1-bis(oxyphenyl)butane, 1,1-bis(oxyphenyl) cyclohexane, 2,2-bis(oxyphenyl)butane, etc. In a particularly preferred embodiment, a bisphenol-A polycarbonate having a number average molecular weight of at least about 25,000 is used. Examples of polycarbonates include General Electric LEXAN® Polycarbonate Resin and Bayer AG MACROLON 5700®. Other polymer classes, with suitable selection, considered practical include cellulose esters, linear polyesters, styrene-acrylonitrile copolymers, styrene-ester copolymers, urethanes, and polyvinyl chloride. Optionally, the central dye image-receiving section may also be coated with an additional dye image-receiving layer comprising a polymer particularly effective at accepting transferred dye, such as a poly(vinyl alcohol-co-butyral).

The polymer must be cast or molded in a thickness and shape of sufficient accuracy that the receiver-frame can be placed in the printing aperture of a photographic printer without flexing or moving during photographic printing. On the other hand, the thickness of the receiver-frame should not be so large that it will not fit into the aperture of a photographic printer, or that optical quality of the image is distorted by the thickness of the polymer. As shown in FIGS. 1-3, the central receiver section 10 of the receiver-frame is of a sufficient thickness t to maintain a flat image plane, preferably from about 0.2 mm to about 3 mm, more preferably from about 1 mm to about 2 mm thick. The integral polymeric frame section extending around the periphery of the central section should be of sufficient thickness T to provide accurate positioning of the central section, and to prevent warpage or flexing of the central section, preferably from about 1 mm to about 9 mm, more preferably from about 3 mm to about 6 mm thick.

Within the preferred ranges of thicknesses, the receiver-frame polymer should: (1) accept dye readily without significant image smearing; (2) have an adequate optical transmission in the visible region of the spectrum; (3) have zero or minimal haze to provide for sharp-image projection; (4) have a surface scratch and dig specification of 10-5 (i.e. no scratches greater than 10 microns in width, and no digs greater than 50 microns depth.); (5) not distort more than 0.20 mm in flatness over a distance of 15 mm; and (6) have a surface roughness smoother than 20Ra microinches as determined by ANSI B46.1.

Dye-donor elements that may be used in the process of the invention conventionally comprise a support having thereon a dye containing layer. Any dye can be used in the dye-donor employed in the process of the invention provided it is transferable to the integral receiver-frame by the action of heat. Especially good results have been obtained with sublimable dyes. The use of dyes in the dye-donor permits a wide selection of hue and color and also permits easy transfer of images one or more times to a receiver if desired. The use of dyes also allows easy modification of density to any desired level. Dye donors applicable for use in the present invention are described, e.g., in U.S. Pat. Nos. 4,916,112, 4,927,803 and U.S. Pat. No. 5,023,228, the disclosures of which are incorporated by reference.

Various methods may be used to transfer dye from the dye donor to the integral receiver-frame to form the reticule image for the focussing tool of the invention. There may be used, for example, a resistive head thermal printer as is well known in the thermal dye transfer art. There may also be used a high intensity light flash technique with a dye-donor containing an energy absorptive material such as carbon black or a light-absorbing dye. Such a donor may be used in conjunction with a mirror which has a pattern formed by etching with a photoresist material. This method is described more fully in U.S. Pat. No. 4,923,860.

In a further preferred embodiment of the invention, the imagewise-heating is done by means of a laser using a dye-donor element comprising a support having thereon a dye layer and an absorbing material for the laser, the imagewise-heating being done in such a way as to produce a desired reticule image pattern. The use of lasers to image-wise heat dye donors to form an imaged focussing tool is particularly desirable as lasers enable greater image resolution than other heat sources, which is particularly useful when working with the relatively small image area of a focussing tool.

Several different kinds of lasers could conceivably be used to effect the thermal transfer of dye from a donor sheet to the dye-receiving element to form the imaged focussing tool of the invention, such as ion gas lasers like argon and krypton; metal vapor lasers such as copper, gold, and cadmium; solid state lasers such as ruby or YAG; or diode lasers such as gallium arsenide emitting in the infrared region from 750 to 870 nm. However, in practice, the diode lasers offer substantial advantages in terms of their small size, low cost, stability, reliability, ruggedness, and ease of modulation. In practice, before any laser can be used to heat a dye-donor element, the laser radiation must be absorbed into the dye layer and converted to heat by a molecular process known as internal conversion. Thus, the construction of a useful dye layer will depend not only on the hue, sublimability and intensity of the image dye, but also on the ability of the dye layer to absorb the radiation and convert it to heat.

Thus, in a preferred embodiment of the process of the invention, a dye image is transferred by imagewise heating a dye-donor containing an infrared-absorbing material with a diode laser to volatilize the dye, the diode laser beam being modulated by a set of signals which is representative of the shape and color of the desired image, so that the dye is heated to cause volatilization only in those areas in which its presence is required on the dye-receiver.

Lasers which can be used to transfer dye from the dye-donor element to the dye image-receiving element to form the imaged focussing tool in a preferred embodiment of the invention are available commercially. There can be employed, for example, Laser Model SDL-2420-H2® from Sepctrodiode Labs, or Laser Model SLD 304 V/W® from Sony Corp. Laser thermal dye transfer imaging devices suitable for use in the process of the invention are disclosed in U.S. Ser. No. 07/457,595 of Sarraf et. al., both filed Dec. 27, 1989, the disclosures of which are hereby incorporated by reference.

Any material that absorbs the laser energy or high intensity light flash described above may be used as the absorbing material such as carbon black or non-volatile infrared-absorbing dyes or pigments which are well known to those skilled in the art. In a preferred embodiment of the invention, an infrared-absorbing dye is empolyed in the dye-donor element instead of carbon dyes from carbon contamination. The use of an absorbing dye also avoids problems of non-uniformity due to inadequate carbon dispersing. In a preferred embodiment, cyanine infrared absorbing dyes are empolyed as described in U.S. Pat. No. 4,973,572, the disclosure of which is hereby incorporated by reference. Other materials which can be empolyed are described in U.S. Pat. Nos. 4,912,083, 4,942,141, 4,948,776, 4,948,777, 4,948,778, 4,950,639, 4,950,640, 4,952,552, 5,019,480, 5,034,303, 50,37,977, and U.S. Pat. No. 5,036,040.

After the dyes are transferred to the receiver, the image may be treated to further diffuse the dye into the dye-receiving surface in order to stabilize the image. This may be done, e.g., by thermal and/or solvent vapor fusing. Solvent vapor fusing may be done by exposing the surface of the receiver-frame to solvent vapor, such as acetone vapor, for a period of a few minutes. Typically, the receiver-frame is placed in a covered pan about 30 cm square and 5 cm deep, having about 1 cm of acetone liquid at the bottom of the pan. The receiver-frame is held in the covered pan for a period of 7 minutes at room temperature, after which time the thermal dyes are found to have fused into the polymeric layer of the receiver-frame, and are stabilized to surface abrasion and fading upon exposure to light. The fusing step also tends to prevent crystallization of the dyes.

In the above process, multiple dye-donors may be used in combination to obtain as many colors as desired in the final reticule image. For example, for a full-color image, four colors: cyan, magenta, yellow and black are normally used.

Spacer beads may be employed in a separate layer over the dye layer of the dye-donor in the above-described laser process in order to separate the dye-donor from the dye-receiver during dye transfer, thereby increasing its uniformity and density. That invention is more fully described in U.S. Pat. No. 4,772,582, the disclosure of which is hereby incorporated by reference. Alternatively, the spacer beads may be employed in or on the dye-receiver as described in U.S. Pat. No. 4,876,235, the disclosure of which is hereby incorporated by reference. The spacer beads may be coated with a polymeric binder if desired.

The actual reticule or focussing image that is transferred to the image-receiving surface of the integral receiver-frame may take any desired form, and may include letters and/or designs. A simple repeating pattern of words or designs with sharp edges is preferred in order to facilitate evaluation of which sections of the image are in or out of focus. One practical focussing image, for example, consists of the word "FOCUS" repeated in an array. A focussing image for use in printers that print from the bottom up and also for use in those that print from the top down may have every other column of words in such an array mirror reversed so that half the columns will be right-reading in each case.

The following example is provided to further illustrate the invention.

EXAMPLE

Integral focussing tool receiver-frames were produced as illustrated in FIGS. 1-3 with the following dimensions by molding Makrolon® CD-2000 (Bayer AG) bisphenol-A polycarbonate pellets using a 50 ton Shinwa Seiki Mold Machine (Mold heat=260° F. (127° C.), Fast heat=650° F. (343° C.)):
L=1.360 inch (34.54 mm)
W=0.930 inch (23.62 mm)
l=1.140 inch (28.96 mm)
w=0.770 inch (19.56 mm)
T=0.200 inch (5.08 mm)
t=0.045 inch (1.14 mm)

Individual dye-donor elements were prepared by coating on a 100 μm poly(ethylene terephthalate) support:

(1) a subbing layer of poly(methyl methacrylate-co-vinylidene chloride-co-itaconic acid) (84:14:2 wt. ratio) (0.10 g/m$^2$),
(2) a second subbing layer of gelatin (0.07 g/m$^2$),
(3) a dye layer containing the magenta dyes (I) and (II) (each at 0.32 g/;m$^2$) and the cyanine infrared absorbing dye (III) illustrated below (0.12 g/m$^2$), DC-510 Silicone Fluid (Dow Corning Co.) (0.02 g/m$^2$) in a Morthane C-86 binder (a proprietary mixture of polymers derived from 4,4'-diphenylmethaneisocyanate, 4,4'-cyclohexanedimethanol and an aliphatic dibasic acid such as adipic acid)(Morton Thiokol Co.) (0.36 g/m$^2$) coated from a butanone, cylcohexanone, and dimethylformamde solvent mixture, and
(4) a spacer-layer of cross-linked poly(styrene-co-divinylbenzene) beads (90:10 ratio)(15 micron average diameter), 10G surfactant (a reaction product of nonylphenol and glycidol)(Olin Corp) (0.004 g/m$^2$) in a binder of Woodlok 40-0212 white glue (a water based emulsion polymer of vinyl acetate)(National Starch Co.)(0.012 g/m$^2$).

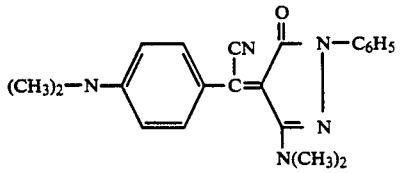
(I)

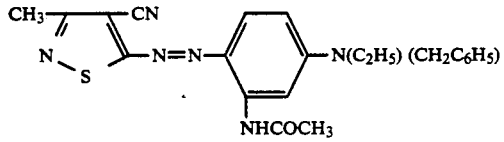
(II)

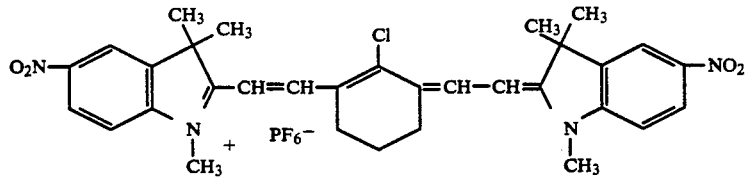
(III)

A single color image of the word "FOCUS" repeated in an array (with every other column of words mirror reversed) was printed as described below from the dye donor sheet onto the integral receiver-frame using a laser imaging device similar to the one described in U.S. Ser. No. 07/457,595 now U.S. Pat. No. 5,105,206. The laser imaging device consisted of a single dio laser (Hitachi Model HL8351E) fitted with collimating and beam shaping optical lenses. The laser beam was directed onto a galvanometer mirror. The rotation of the galvanometer mirror controlled the sweep of the laser beam along the x-axis of the image. The reflected beam of the laser was directed onto a lens which focused the beam onto a flat platen equipped with a clear acrylic plastic holder equipped with thumbscrews to attach it to the platen. The platen was attached to a moveable stage whose position was controlled by a lead screw which determined the y axis position of the image. The receiver-frame was held tightly to the platen and the dye-donor element was held tightly to the receiver-frame by means of the clear acrylic plastic holder.

The laser beam had a wavelength of 830 nm and a power output of 37 mWatts at the platen. The measured spot size of the laser beam was an oval 7 by 9 microns (with the long dimension in the direction of the laser beam sweep) The center-to-center line distance was 9 microns (2822 lines per inch) with a laser scanning speed of 10 Hz. With this device, the imaging electronics allow any kind of image to be printed.

The imaging electronics were activated and the laser beam scanned the dye-donor to transfer dye to the receiver-frame in accordance with the desired focussing image. After imaging the receiver-frame was removed from the platen and the dyes were fused into the receiving polymer by placing the receiver-frame into an acetone vapor bath for 7 minutes at room temperature. At the end of the acetone vapor treatment an initial gold reflection color was dissipated. Focussing tools with images having high density, excellent uniformity, and well defined sharp edges were obtained with the integral receiver-frames of the invention.

The invention has been described in detail with particular reference to preferred embodiments thereof, but it will be understood that variations and modifications can be effected within the spirit and scope of the invention.

What is claimed is:

1. A dye-receiving element for thermal dye transfer suitable for forming a focussing tool comprising a polymeric central dye image-receiving section having a substantially planar image receiving surface and a relatively thicker integral polymeric frame section extending around the periphery of said central section, said image receiving surface being formed at an inclined angle relative to the frame section.

2. The element of claim 1 wherein said frame section is from about 1 to about 9 mm thick.

3. The element of claim 2 wherein said central dye image-receiving section is from about 0.2 to about 3 mm thick.

4. The element of claim 3 wherein the frame section is from about 3 to about 6 mm thick.

5. The element of claim 1 wherein the central section and integral frame comprise a thermoplastic polymer.

6. The element of claim 5 wherein the central section and integral frame comprise a polycarbonate.

7. The element of claim 1 wherein the inclined angle is from 1° to 15°.

8. The element of claim 7 wherein the inclined angle is about 5°.

9. The element of claim 1 wherein external dimensions of said frame section are about 24 mm by about 35 mm.

10. The element of claim 9 wherein the dimensions of said central dye image-receiving section are about 20 mm by about 29 mm.

11. A process of forming an imaged focussing tool comprising:

(a) imagewise-heating a dye-donor element comprising a support having thereon a dye layer, and (b) transferring portions of the dye layer in a pattern corresponding to a desired focussing image to a dye-receiving element suitable for forming a focussing tool comprising a polymeric central dye image-receiving section having a substantially planar image receiving surface and a relatively thicker integral polymeric frame section extending around the periphery of said central section, said image receiving surface being formed at an inclined angle relative to the frame section.

12. The process of claim 11 wherein the frame section is from about 1 to about 9 mm thick.

13. The process of claim 12 wherein the central dye image-receiving section is from about 0.2 to about 3 mm thick.

14. The process of claim 11 wherein the central section and integral frame comprise a polycarbonate.

15. The process of claim 11 wherein the inclined angle is from 1° to 14°.

16. The process of claim 11 wherein external dimensions of said frame section are about 24 mm by about 35 mm and the dimensions of said central dye image-receiving section are about 20 mm by about 29 mm.

17. The process of claim 11 wherein a dye image is transferred by imagewise heating a dye-donor containing an infrared-absorbing material with a diode laser to volatilize dye in the dye layer, the diode laser beam being modulated by a set of signals representative of the shape and color of the desired image.

18. The process of claim 17 wherein said infrared-absorbing material is an infrared absorbing dye.

19. An imaged focussing tool obtained by the process of claim 17.

20. An imaged focussing tool obtained by the process of claim 11.

* * * * *